United States Patent [19]

Schilling

[11] 4,295,821

[45] Oct. 20, 1981

[54] APPARATUS FOR BURNING LIQUID FUEL

[75] Inventor: Siegfried Schilling, Volketswil, Switzerland

[73] Assignee: Oertli AG Dubendorf, Zurich, Switzerland

[21] Appl. No.: 68,404

[22] Filed: Aug. 21, 1979

[30] Foreign Application Priority Data

Aug. 21, 1978 [DE] Fed. Rep. of Germany ..... 2836534

[51] Int. Cl.[3] ..... F23D 15/02

[52] U.S. Cl. ..... 431/353; 431/170; 431/265; 431/352; 431/347

[58] Field of Search ..... 431/8, 7, 170, 347, 431/348, 351, 352, 353, 265; 60/737, 740, 743, 753, 754

[56] References Cited

U.S. PATENT DOCUMENTS

| | | | |
|---|---|---|---|
| 2,181,186 | 11/1939 | Jackson | 431/348 |
| 2,447,482 | 8/1948 | Arnold | 60/754 |
| 2,469,272 | 5/1949 | Logan | 431/352 |
| 2,669,300 | 2/1954 | Blaha | 431/348 |
| 3,030,773 | 4/1962 | Johnson | 431/352 |
| 3,229,464 | 1/1966 | Mock | 60/743 |
| 3,603,711 | 9/1971 | Downs | 431/352 |
| 3,802,829 | 4/1974 | Morris | 431/347 |
| 3,952,504 | 4/1976 | Sedgwick | 60/753 |

FOREIGN PATENT DOCUMENTS

| | | | |
|---|---|---|---|
| 2714824 | 10/1978 | Fed. Rep. of Germany | 431/352 |

*Primary Examiner*—Samuel Scott
*Assistant Examiner*—Lee E. Barrett
*Attorney, Agent, or Firm*—James E. Nilles

[57] ABSTRACT

A burner apparatus for burning liquid fuels is equipped with a swirl atomizer nozzle (4), a flame holder (22) that is connected behind the nozzle mouth, and a combustion air delivery duct (8), in which the nozzle (4) is arranged coaxially. A thermally decoupled duct-like heat conductor (10) functions as a fuel vaporizer in the operation of the apparatus. In its main portion, which starts a small distance downstream from the nozzle, the heat conductor has an inside diameter such that droplets in the spray cone from the nozzle tend to impact evenly over the whole area of its inner surface. The heat conductor (10) is of silica nitride. It comprises at least partially a capillary inner layer.

5 Claims, 12 Drawing Figures

APPARATUS FOR BURNING LIQUID FUEL

FIELD OF THE INVENTION

This invention relates to the combustion of liquid fuels with combustion air from a low pressure blower, and the invention is more particularly concerned with the attainment of very complete soot-free combustion of liquid fuel in a nearly stoichiometric fuel-air mixture with the employment of burner apparatus that comprises a swirl atomizer nozzle coaxially arranged in a combustion air delivery duct.

BACKGROUND OF THE INVENTION

In the interest of energy conservation and the protection of the environment from both noise and objectionable combustion exhaust gases, the technical world is striving to develop methods and apparatus that will effect the most complete possible combustion of fuel with the best possible thermal efficiency and with the least possible noise emission.

As is known, burners for heating oil that are in the capacity range of one to 1000 kg. per hour are preponderantly of the type in which the liquid fuel is atomized under relatively high pressure to produce oil droplets that emerge from the nozzle in a more or less conical cloud. The droplets in this cloud are of various sizes, and there is no consistency in the distribution of the various size droplets across the cloud.

For good combustion of the atomized fuel it is of critical importance that the oil droplets be thoroughly mixed with combustion air and that the oxygen component of the air have the proper relationship to the atomized fuel with which it is intended to combine in the combustion process.

According to conventional practice, formation of the fuel-air mixture is initiated in a so-called mixing device and is continued and ended in the combustion chamber of the heat producer (furnace or the like). In general, mixing devices are so arranged that mixing of atomized fuel with combustion air begins directly after the fuel leaves the atomizer nozzle, in the plane of a so-called flame holder. The combustion air is conducted to the atomized fuel stream at a fairly high velocity and carries the fuel droplets along with it through an igniter and into a burner duct.

To some extent mixture formation and combustion occur sequentially in point of time, but considered across the whole volume of the fuel-air mixture, both in cross-section and in the stream flow direction, both processes are occurring simultaneously. Mixture formation and combustion therefore influence each other mutually and are determined to a substantial extent by the geometry of the combustion chamber and the thermodynamic relationships that develop in it.

Although the quality of the fuel-air mixture is to a large extent dependent upon the size of the oil droplets and the uniformity of their distribution in the spray issuing from the atomizer nozzle, commercial nozzles of like size and presumably like characteristics provide very different spectra of droplet size and distributions across the stream cross-section. This leads to unsatisfactory combustion and impels the use of counter-measures such as increasing the velocity of the combustion air stream, and/or increasing the excess of combustion air. However, this has undesirable secondary effects, including greater heat loss due to higher exhaust gas flow volume, the formation of peripheral fuel clouds at the flame root and the flame belly, the supercooling of the flame holder and its consequent substantial sooting, and increase of the noise level.

A wide variation in atomizing characteristics is particularly evident with pressure atomizer nozzles for oil throughputs of less than 2 kg/hr., by reason of their necessarily small bores and channels. The uncertain character of the output of such a nozzle is further aggravated by its sensitivity to sooting. In this capacity range, unsatisfactory oil cloud quality can be compensated for to a limited extent by increase of combustion air flow. But there are technical and economic limits to the permissible reduction of stream cross-section and the increase of excess air that accompany this expedient. Nevertheless, on the basis of experience, high combustion air flow velocities have been relied upon to provide good combustion qualities for conventional mixing devices with flame holders.

Thus, so-called combustion aids for improving combustion are known in combustion technology. These include whole or partial lining of the combustion chamber with refractory ceramics, and/or the provision of a duct of scale-free steel which wholly or partially surrounds the flame along its whole length or a part of its length.

Other such measures include lengthened burner ducts in various structural forms, with or without ceramic linings for heat storage and/or for supporting recirculation of combustion air. A limitation upon the employment of this last expedient is that the maker of the burner has no constructive influence upon the form of the combustion chambers in heat generators, particularly in the medium, small and very small capacity ranges.

The diameter of such a burner duct is, as a rule, so selected that no oil drops impinge upon its wall surface, anywhere around it or along its length, so that the flame can be conducted through the longest possible stretch. This leads to relatively large and long burner ducts, and consequently to substantial depths of immersion in the combustion chamber.

Measures for effecting a controlled recirculation of combustion gases are relatively expensive and create a need for devices to assist in starting the burner, such as motor controlled air dampers. These are necessary because the high stream velocity of the operating jet, required for stimulating recirculation, tends to prevent ignition at full load.

A large number of burner devices of this type have become known, differing in concept and operating according to various methods. Thus, there has been published a disclosure of a method of combusting liquid fuels wherein heating oil and deisel oil are burned with air by first atomizing the fuel with a mechanical atomizer, then tangentially introducing a further gaseous medium, after which air is introduced in a coaxial, same direction flow. This, like other burner apparatus, cannot be operated with a stoichiometric fuel-air relationship, so that soot is formed if the apparatus is operated with an insufficient excess of combustion air in an effort to maintain a near-stoichiometric relationship. The soot thus formed coats the combustion chamber and its outlet portions and very seriously deteriorates the heat transfer capabilities.

To avoid undesired soot formation, burner devices are as a rule operated with so much excess combustion air that—although the fuel is completely combusted—the flue gases are emitted with a substantial oxygen content. Optimum combustion efficiency cannot be achieved in this manner. Furthermore, experience shows that the very employment of excess air prevents the attainment of stoichiometric combustion, so that soot formation occurs notwithstanding.

A German Published Patent Application, DE-OS No. 2,511,500, proposes a method for burning liquid fuel which would purportedly permit operation without soot formation, under stoichiometric conditions and even with less than stoichiometric conditions, that is, with too small a proportion of combustion air. These objectives are said to have been realized with a variety of measures and structures by a stabilization of the mixture flow, accomplished by control of stream flow and stream temperature. Such control is said to be afforded by means of an insert downstream from the atomizing and mixing zone which produces a contraction of the stream flow that follows an expansion of it and is in turn followed by another expansion at the eye of the flame. With this it is also recommended that there be a markedly widened diffuser of ceramic material following the nozzle mouth; or else a ceramic combustion air duct of constant inner cross-section which is connected to its outlet and which is narrowed ahead of the atomizer nozzle, and then constant air introduction ducts of double-cone-shaped design with a cross-section that first widens, then narrows, or a cross-section that first narrows, then widens. Almost all forms that are possible with the basic arrangement are shown and described, so that for the combustion technician, and particularly for the atomizing technician, there is a disclosure of the entire possible field of combustion devices of this type, irrespective of how and why they can solve the problem and whether or not they can do so.

It is interesting that this disclosure points out that the portion which is downstream from the nozzle and which defines the mixing chamber should be of heat retaining material in order to stabilize the flame; and it specifies ceramic parts for this purpose. However, the significant teaching of this publication from the standpoint of the present invention is its advice that the configuration of the burner duct is to be so selected that combustion air is brought into the mixture stream of oil droplets and supplemental medium but that it must not in any event be so configured so as to permit oil droplets to settle on its convergent wall downstream from the burner.

Insofar as one adheres to the teaching of the publication that no oil droplets can settle on the narrowing wall, no amount of experimentation with the burner apparatus disclosed in it will lead to a solution of the problem to which it is supposedly addressed.

Basically, it can be said that the known embodiments of combustion devices, and the known methods of operating them, mainly relate to the capacity range above 2 kg/hr., and are unsatisfactory under intermittent operating conditions, particularly evident from relatively heavy soot formation during burner start-up.

SUMMARY OF THE INVENTION

The present invention takes account of the relevant knowledge concerning atomization of liquids and the flow stream conditions that occur in burners for liquid fuels, and also taken into consideration that gas viscosity rises markedly with the high combustion temperatures normally attained, whereas the density, according to the Gay-Lussac law, falls with rising temperature. Having in mind practical experience with soot formation, especially in intermittently operated burner devices, the present invention has as an object the provision of a method of combusting liquid fuels at small mixture ratios in an apparatus that comprises at least one atomizer, with the intention of achieving a very nearly stoichiometric $CO_2$ quantity, with no soot formation apparent after shut-off of the device, with low-noise operation of the burner owing to relatively small gas and air velocities in the apparatus, and with practically no hydrocarbons carried in the flue gases; and to satisfy these requirements over a large range of excess combustion air proportions and particularly with the $O_2$ content of the exhaust air or the flue gases maintained between about 2% and about 9% by volume.

The method of combusting liquid fuels that achieves this objective is characterized by collecting 20% to 40% by weight of the total atomized fuel on a thermally de-coupled heat conductor by which the fuel is evaporated, mixing the fuel with air as it evaporates, and immediately burning it, all in such a manner that the parts of the burner apparatus are free from soot after shut-down, and the $O_2$ content of the combustion gas is below 10.1% by volume.

A burner apparatus for practicing this method is characterized by a thermally decoupled duct-like heat conductor which diverges in the direction of stream flow and which functions as a fuel vaporizer in the operation of the apparatus.

In contrast to the generally-sought prevention of settling of atomized fuel on the mixture guiding walls, as expressly taught in DE-OS No. 2,511,500, the present invention takes account of the virtual impossibility of preventing liquid particles from contacting the walls and encourages such contact, taking advantage of it to effect a prompt evaporation of the fuel particles. For this there is required a thermally decoupled heat conductor which functions as an auto-thermal evaporator and can therefore function during the starting phase without the introduction of outside energy, that is, with energy for evaporation that is obtained from the flame itself.

BRIEF DESCRIPTION OF DRAWINGS

In the accompanying drawings, which illustrate what are now regarded as preferred embodiments of the invention.

DETAILED DESCRIPTION OF THE INVENTION

Figure 1:
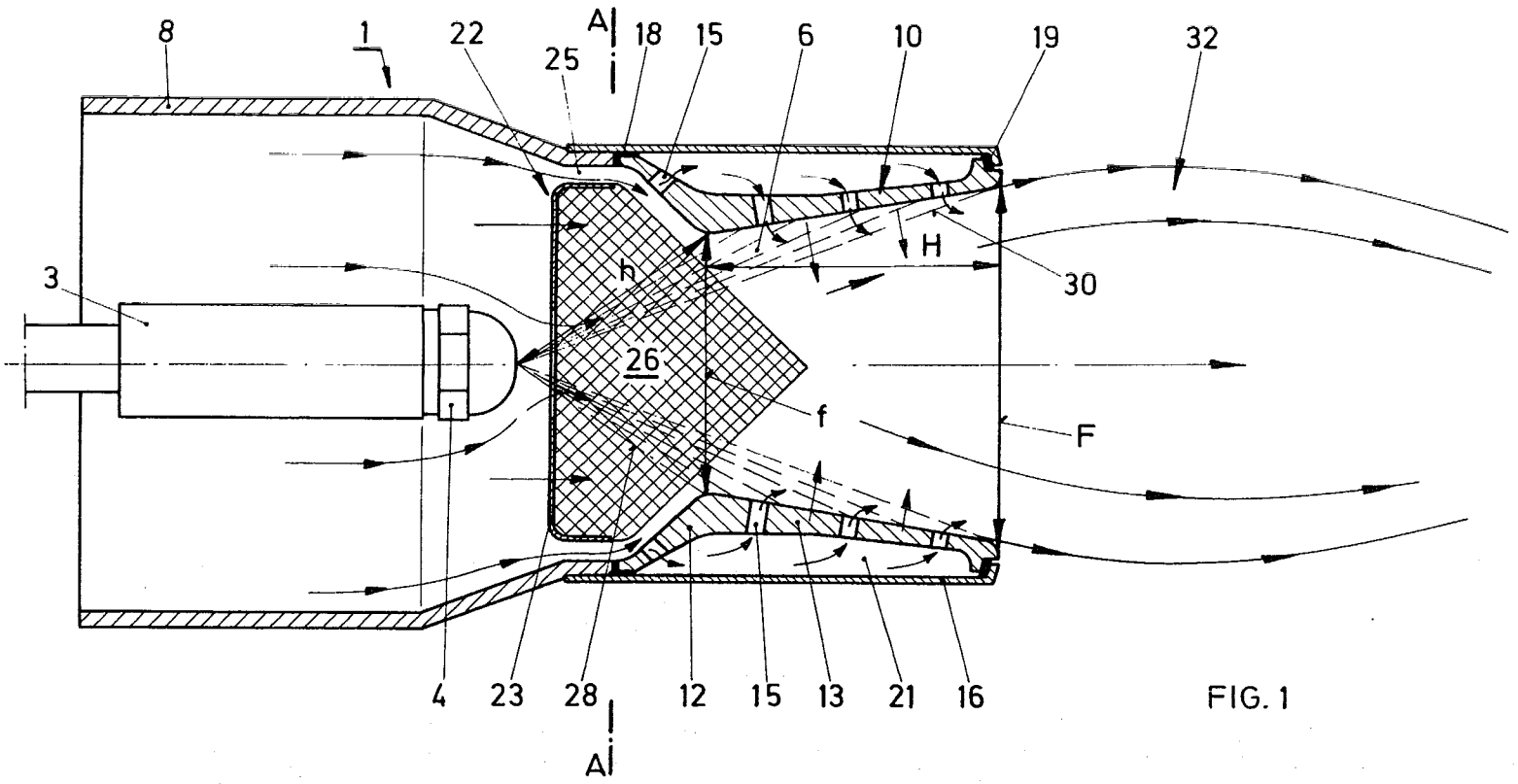
FIG. 1 is a view in longitudinal section through a burner device which embodies the principles of the invention.

The combustion apparatus 1 of this invention comprises a nozzle stem 3 of known type that has at its front end an atomizing swirl nozzle 4 from which liquid fuel is emitted in the form of a hollow cone 6 of droplets.

Coaxially surrounding the nozzle stem 3 and extending a short distance forwardly beyond its nozzle outlet 4 is a duct 8 through which all of the combustion air flows. Coaxially connected to the downstream end of the burner duct 8 is a vaporizer insert 10 that has a rather abruptly converging inlet portion 12 and a more gradually diverging final diffuser portion 13. There are bores 15 through the annular wall of the vaporizer insert 10, both in its inlet portion 12 and in its diffuser portion 13.

The vaporizer insert 10 is surrounded by a supporting duct 16 which, from a structural standpoint, comprises a forward extension of the combustion air duct 8. Although the vaporizer insert 10 is mechanically connected to the front of the combustion air duct 8 and to the inner surface of the supporting duct 16, and is thus supported by the ducts 8 and 16, it is nevertheless thermally decoupled and isolated from them by means of heat insulating rings 18 and 19 through which it has its connections with the ducts 16 and 18. Thus, heat energy introduced into the vaporizer insert 10 cannot flow away from it into or through the metal parts of the combustion air duct 8 or the supporting duct 16. The supporting duct 16, which can be of uniform diameter along its length, cooperates with the evaporator insert 10 to define an annular chamber 21.

Just downstream from the swirl nozzle 4 there is a flame holder 22 which has an apertured base 23 and which is also generally conventional in other respects. Part of the combustion air that flows in through the combustion air duct 8 enters the cone-like cloud 6 of fuel droplets through the apertured base 23 of the flame holder 22, through which the atomized fuel also passes. The remainder of the combustion air flows around the flame holder 22 and thus through an annular air channel 25 that is inwardly bounded by the flame holder 22 and outwardly bounded by the front end portion of the combustion air duct 8 and the rear end portion of the vaporizer insert 10. However, only a portion of the combustion air that passes through the annular air channel 25 remains within the interior of the vaporizer insert 10 and flows directly to its diffuser portion 13; another portion of that air passes through the bores 15 in the convergent inlet portion 12 of the vaporizer insert 10 and thus into the annular chamber 21, from which it flows back into the diffuser portion 13 through the bores 15 therein.

FIG. 1 illustrates purely schematically the flame cone 26 as well as the outer surface boundary 28 and the inner surface boundary 30 of the hollow cone 6 of spray droplets issuing from the nozzle 4. The flame 32 is illustrated in a more or less stylized manner as a continuation of the flame cone 26.

When the burner apparatus 1 is in operation, combustion air is delivered through the combustion air duct 8 from a low pressure blower (not shown), as is generally conventional; and a conventional ignition device (not shown) operates to ignite the atomized fuel issuing from the swirl nozzle 4 and to burn it with the combustion air so that the flame cone 26 is formed. Owing to the low form drag of the larger fuel droplets issuing from the nozzle 4, they tend to be mainly concentrated at and near the radially outer boundary of the surface of the hollow spray cone 6, and accordingly they tend to impinge against the vaporizer insert 10. Since the vaporizer insert is very rapidly heated by the flame, and heat flow out of it is prevented by the insulating rings 18 and 19 as well as by the thermal insulation which the surrounding annular chamber 21 affords, the droplets that contact the vaporizer insert 10 are evaporated almost immediately upon contact.

The length H of the vaporizer insert 10, as measured in the flow direction, is such that the radially inner droplets in the spray cone 6 can also contact it. In general, however, they do not do so because they tend to be the smallest droplets in the cone and therefore burn before they have progressed far enough forward to encounter the vaporizer insert surface.

The oxygen needed for continued combustion is supplied by the combustion air that enters the diffuser portion 13 of the vaporizer insert from the annular chamber 21, with the result that a flame 32 is produced which has substantially the form illustrated.

With this, as with any burner apparatus, it is essential that after shut-down there be no traces of soot on any of the parts, and especially not on the vaporizer insert 10. The vaporizer insert is therefore so designed that the straightline distance h from the outlet of the nozzle 4 to the nearest location at which fuel droplets could contact the vaporizer insert (i.e., as measured along the outer surface 28 of the fuel cone 6) is of the same order of magnitude as the diffuser length H. In the presented illustrated case this relationship is $H:h \cong 1.25$. The corresponding cross-section surfaces F and f (see FIG. 1) are maintained in the relationship $F:f \cong 2:1$. A relationship $H:h \cong 1$ is also possible.

Because of the above described thermal decoupling of the vaporizer insert 10, substantially no heat flows away from it except such as is removed in vaporizing the droplets of fuel that contact it. It therefore heats very fast and maintains a high temperature so that very intensive fuel vaporization takes place, beginning almost immediately upon start-up of the burner.

The vaporizer insert 10 is preferably so formed that the portion of it which is nearest the nozzle 4, and is therefore impinged by the greatest portion of the fuel that contacts it, has a thicker wall and thus, by reason of comprising more material, has a greater heat retention capacity than the front end portion.

The material of the vaporizer insert 10 is preferably silicon nitride although aluminum titanate and glass are also considered suitable. Preferably the material is somewhat porous, to improve humidifying qualities by reason of capillary action that tends to take place at the vaporizer insert surface. By reason of such capillary action, assurance is had that liquid droplets which alight on the hot surface of the vaporizer insert will be completely evaporated instead of rebounding and being slung into the combustion chamber in the form of small vapor-coated spheres, as the result of the Leidenfrost phenomenon.

Figure 2:
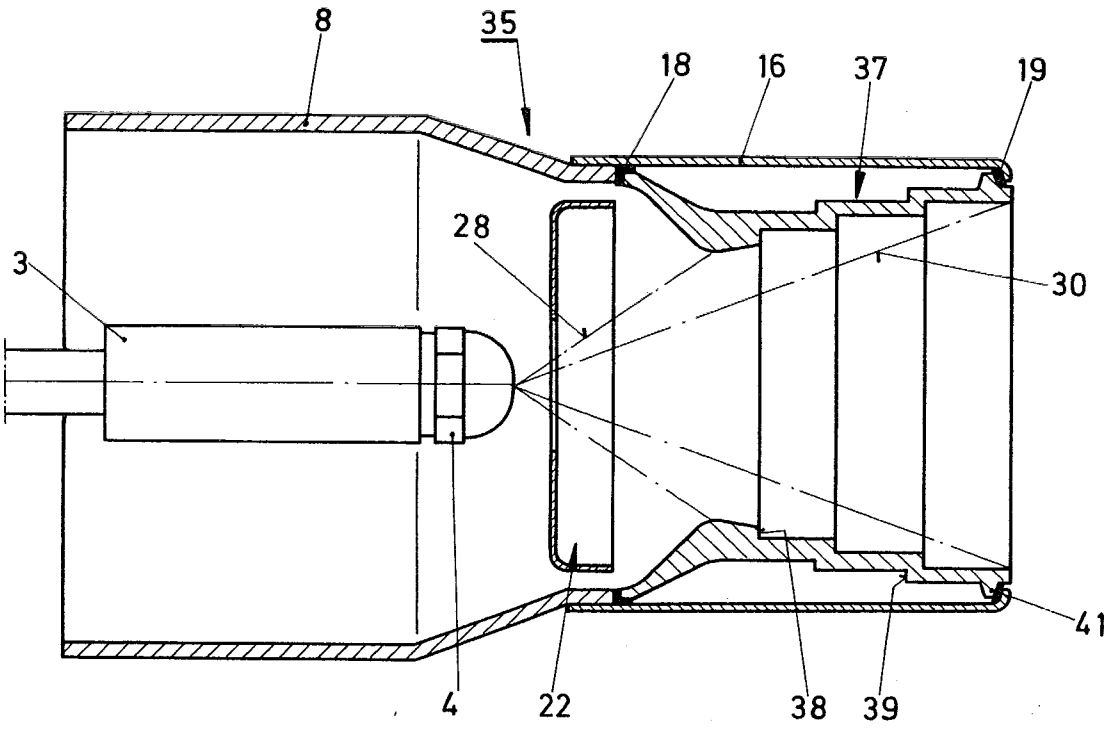
FIG. 2 is a view generally similar to FIG. 1 but showing a modified embodiment of the invention wherein the front portion of the heat conductor has stepwise offset inner surfaces.

The burner apparatus 35 that is illustrated in FIG. 2 is basically like that of FIG. 1, but its vaporizer insert 37 is characterized by a diffuser portion that has inner and outer surfaces of forwardly stepwise increasing diameters to provide inner steps 38 and outer steps 39. An outer sealing flange 41 is also shown. As compared to the vaporizer insert configuration shown in FIG. 1, the stepped diffuser section wall affords a greater amount of active surface for evaporation and at the same time improves swirl formation for the purpose of mixture improvement.

Figure 3:
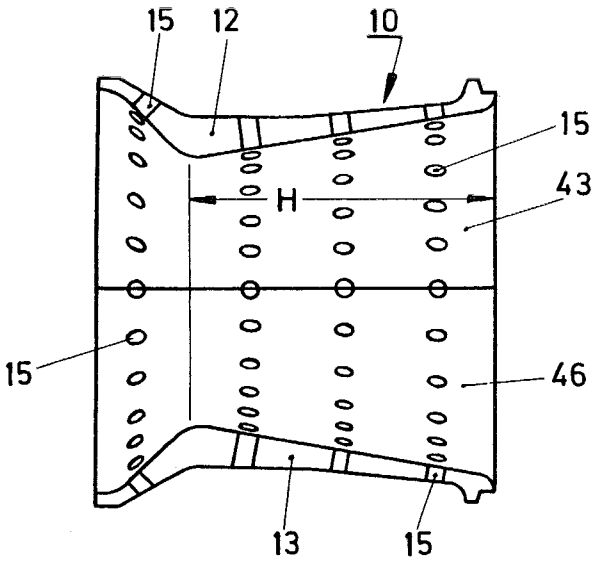
FIG. 3 is a view in longitudinal section of another modified form of heat conductor for apparatus generally like that illustrated in FIG. 1 but comprising an assembly of segmental parts.
Figure 4:
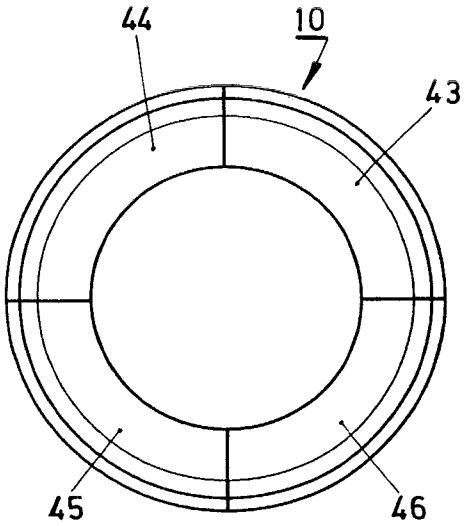
FIG. 4 is a front end view of the heat conductor shown in FIG. 3.

FIGS. 3 and 4 illustrate a vaporizer insert 10 that is generally like the one illustrated in FIG. 1 but comprises four identical sector-like parts 43–46 which are secured together radially by the supporting duct 16 that surrounds them and are confined against axial displacement relative to one another by their insulating connections with the ducts 8 and 16. The approximate distribution of the bores 15 can also be seen.

Figure 5:
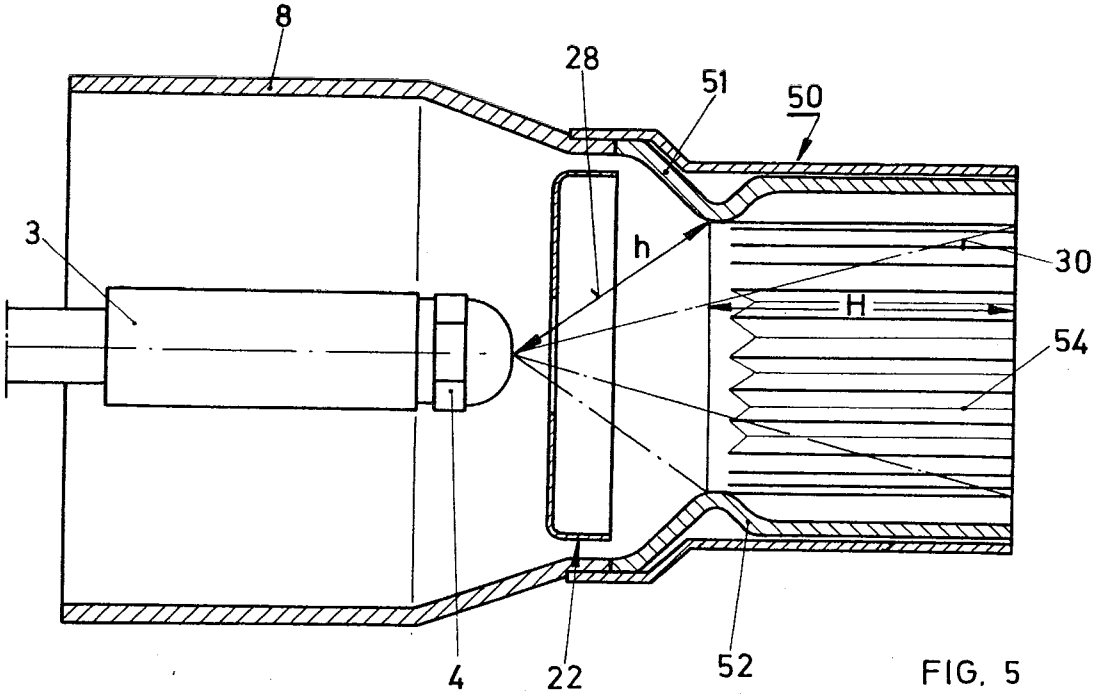
FIG. 5 is a view generally similar to FIG. 1 but illustrating still another modified form of heat conductor having at its front portion an inner surface with a more or less saw-toothed profile in cross-section.
Figure 6:
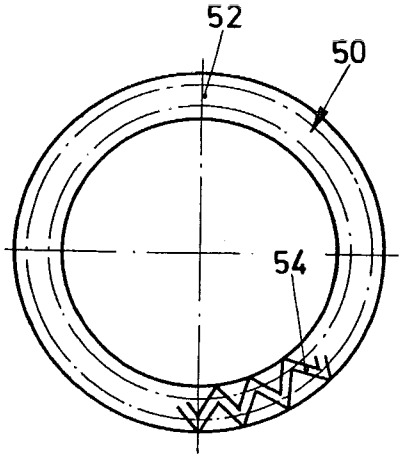
FIG. 6 is a front view of the heat conductor shown in FIG. 5.

The burner apparatus illustrated in FIGS. 5 and 6 has a vaporizer insert 50 with a forwardly converging inlet section 51 and a diffuser section 52 which has a forwardly divergent rear end portion but is of uniform diameter along most of its length. However, the uniform diameter portion of the diffuser has an inner wall surface with longitudinally extending lands 54 and grooves that give it a tooth-like or serrated profile in cross-section, as best seen in FIG. 6. The purpose of the lands 54 is of course to increase the active inner wall surface of the vaporizer while maintaining the same basic diameter for it.

Figure 8:
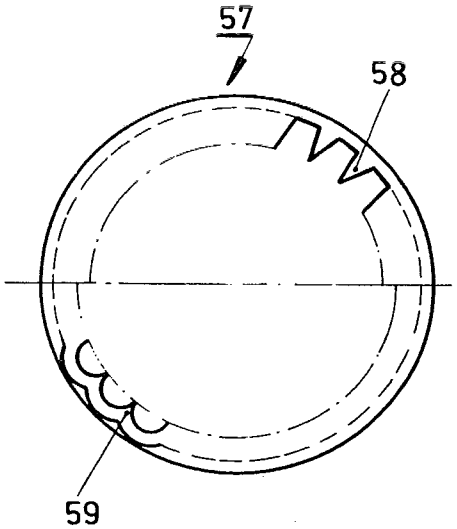
FIG. 8 is a front view of the heat conductor shown in FIG. 7.
Figure 7:
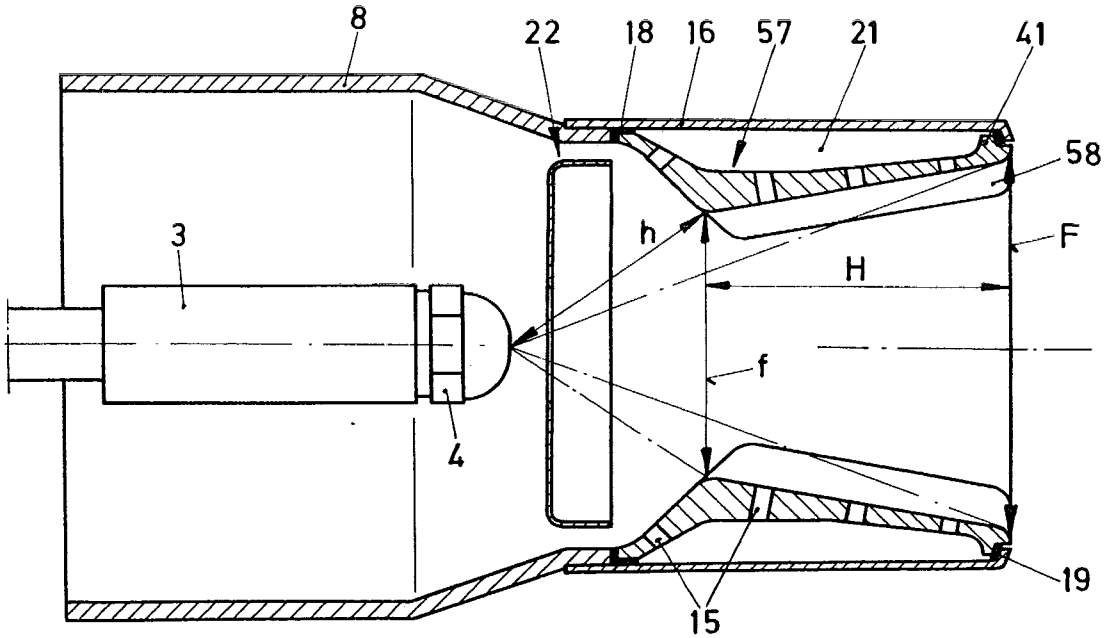
FIG. 7 is a view generally similar to FIG. 5 but illustrating a modified form of inner surface on the front end portion of the heat conductor, characterized by longitudinally extending internal ribs.

FIGS. 7 and 8 illustrate a further possible variation of the vaporizer insert 57, which in general resembles the insert 10 of FIG. 1 but, like that of FIGS. 6 and 7, has longitudinally extending ribs 58 in its diffuser section to increase the effective surface area thereof. In this case the ribs can be formed to provide a tooth-like profile, as at 58 in FIG. 8, or can define rounded grooves as at 59 in FIG. 8.

Figure 9:
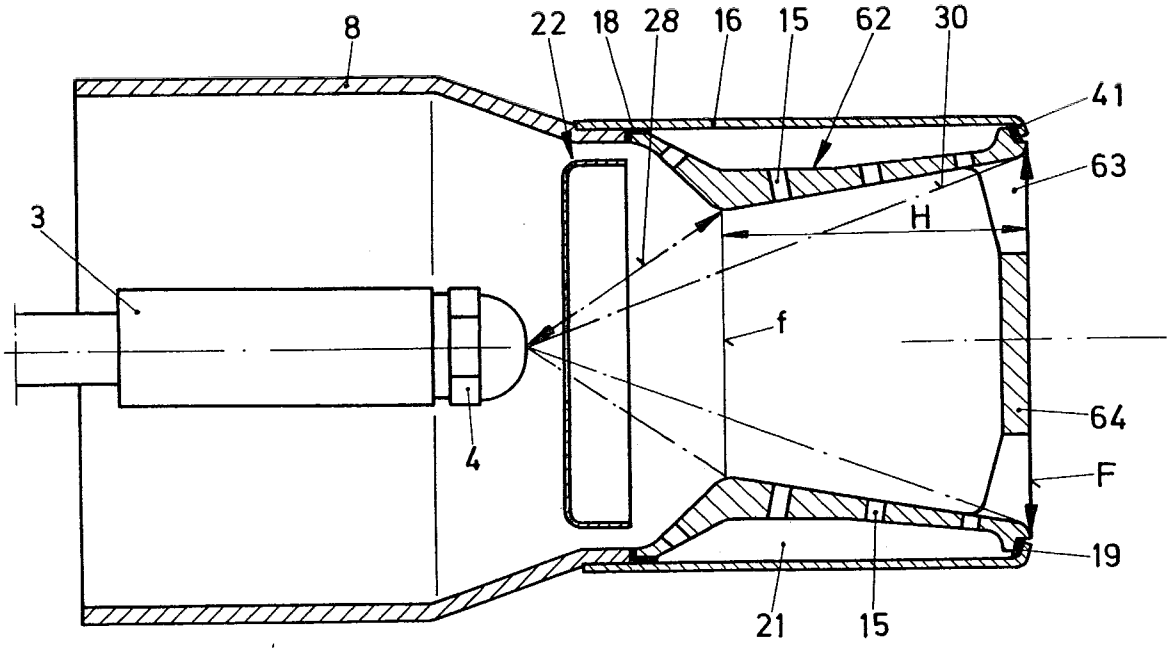
FIG. 9 is a view generally similar to FIG. 5 but showing a further variant of the heat conductor, with a baffle plate at its outlet that is supported by short, longitudinally extending ribs.
Figure 10:
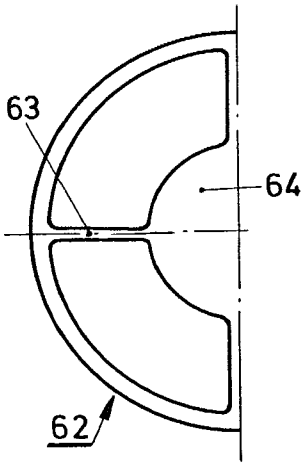
FIG. 10 is a partial front view of the heat conductor shown in FIG. 9.

In the embodiment of the invention illustrated in FIGS. 9 and 10 the vaporizer insert 62 has a transversely extending rebound plate 64 at its front, supported by ribs 63 which connect it with the side wall and which are rather short axially. The rebound plate 64 serves for shortening the flame. In other respects this variant is similar in construction and operation to the previously described embodiments of the invention.

Figure 11:
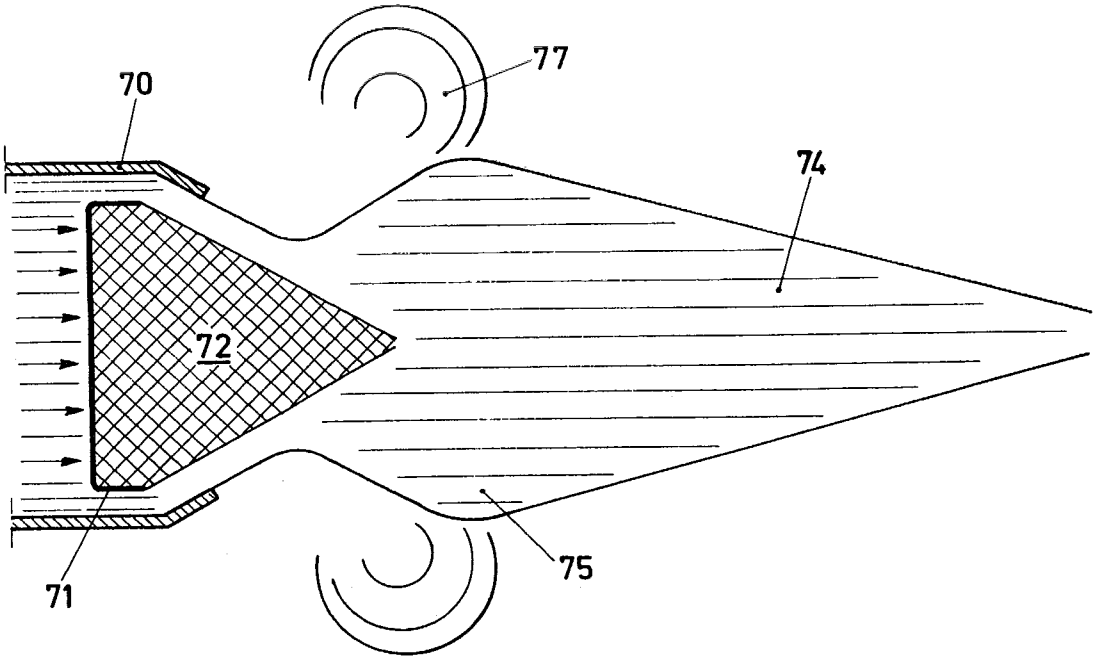
FIG. 11 is a purely schematic illustration of the form that is assumed by stream flow through the combustion apparatus, as seen in longitudinal section.

The purely schematic FIG. 11 shows a part of a burner duct 70, a flame holder 71 with a flame cone 72 as well as a flame body 74 with a flame belly 75. Marginal swirls 77 are shown in the region of the flame belly 75. In normal operation, burner apparatus according to the above described figures produces a flame which perceptibly resembles this illustration.

Figure 12:
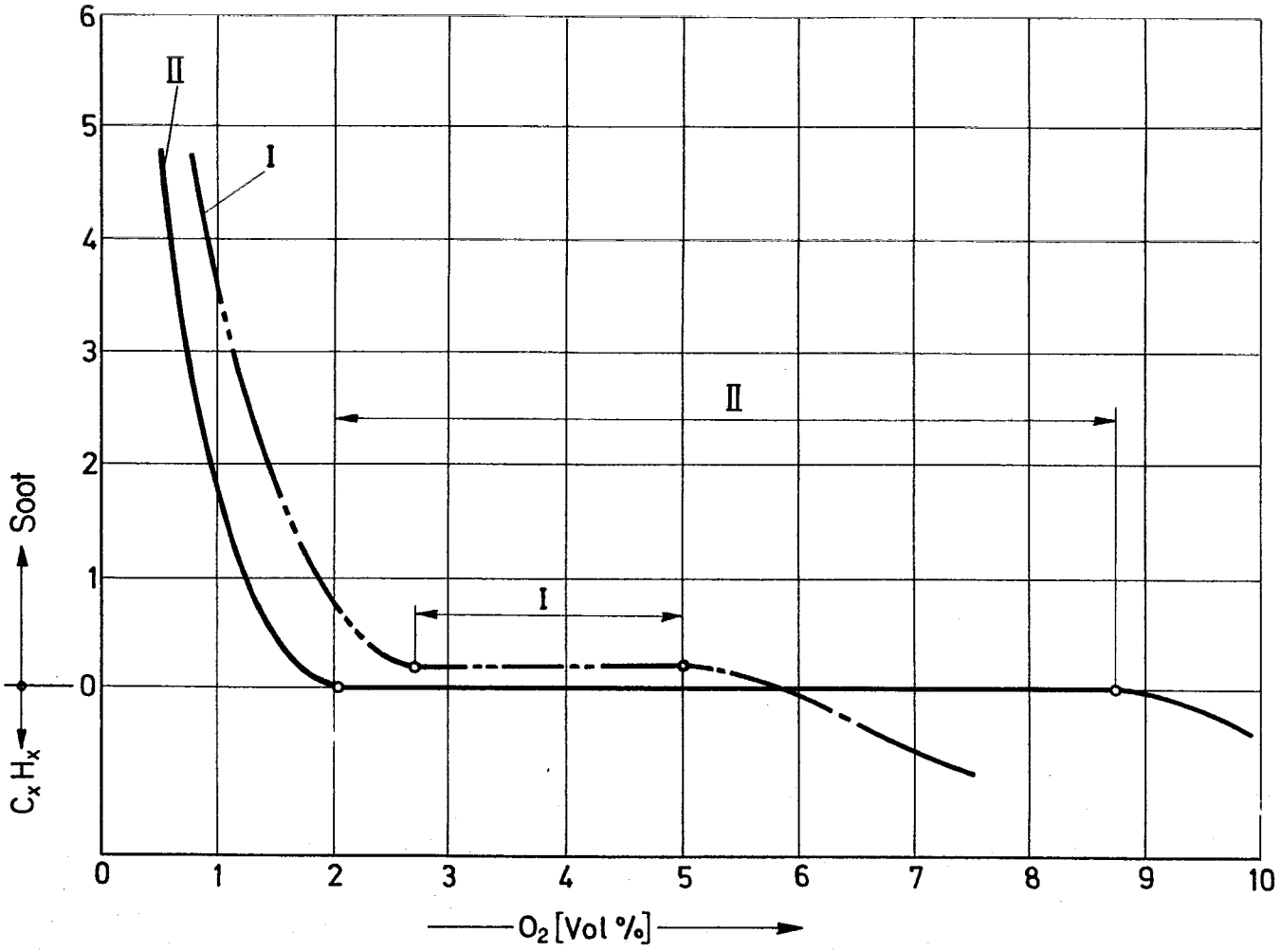
FIG. 12 is a diagram illustrating the combustion of liquid fuel, with quantities of hydrocarbon compounds present in the flue gas and with relative quantities of soot formed, both as a function of the oxygen content (in percentage by volume) in the fuel-air mixture, with and without the inclusion of a thermally decoupled heat conductor functioning as a vaporizer.

FIG. 12 gives experimental curves for burner apparatus according to the invention as described above. These curves were obtained by making comparative measurements on burner apparatus operated with and without vaporizer inserts. The working range for operation without a vaporizer is designated by I, that for operation with a vaporizer is designated by II. From these experimental results it can be seen that with the vaporizer insert of this invention, totally soot-free operation can be obtained through the range in which the excess oxygen content in the flue gas is between about 2% by volume and not quite 9% by volume; and through this excess oxygen range the exhaust gas is also free from hydrocarbons. In contrast, for operation without an evaporator, these conditions were attained only when the excess oxygen content was 6%, and in the normal operating range there was always at least a small amount of soot. Below the normal range, without a vaporizer insert, the soot quantity increased very steeply, while in the upper range the hydrocarbon content in the flue gases increased.

These results demonstrate the great advantage and the very great effectiveness of the vaporizer insert of this invention with respect to attainment of combustion efficiency and protection of the environment from objectionable flue gases.

The portion of fuel that encounters the surface of the vaporizer insert should be at least 20% by weight but not more than 40% of the total throughput. With the maximum limit, assurance is had that at cold starting the combustion will not proceed with too great an amount of excess air and cause hydrocarbons to be detectable in the flue gas.

Naturally, the large drops that are at and near the boundaries of the spray cone, due to their relatively high kinetic energy, break through the air or gas stream and impinge against the vaporizer wall surfaces. With conventional mixing devices these drops are responsible for marginal cloud fields of fuel at the flame root or the flame belly (FIG. 11).

The smaller drops mix with the air directly downstream from the flame holder and react with the oxygen to burn as they pass through the vaporizer. The heat energy thus released is transferred to the vaporizer, in part by radiation and in part by convection, to heat the vaporizer walls to over 500° C.

At the flame holder there is a luminous flame cone which, immediately after burner start-up, produces sufficient luminosity for exposure of a conventional photoelectric flame monitor.

The stability of the flame is assured by means of the maximum possible air impulse flow. For this, in contrast to prior arrangements, all of the combustion air is initially conducted through the mixing plane A—A.

For fuel to be evaporated off of the vaporizer without leaving a residue, it is not only necessary that the temperature of the vaporizer wall be sufficiently high but also that there be an adequate oxygen concentration in the vicinity of the vaporizer wall. With the present invention, adequacy of oxygen supply is assured by the cooperation of the flame holder with the vaporizer insert, and particularly with the convergent front section of the insert, and by directing combustion air from the annular chamber around the vaporizer insert radially inwardly back into the diffuser section of the insert. By reason of this air flow pattern the air is well mixed with fuel vapor.

Preponderantly, the evaporated fuel that mixes with the air constitutes the lower-boiling fractions of the fuel; a portion of the oxygen of the air reacts with the higher boiling fuel fractions on the surface of the vaporizer insert. Research has shown that the fuel components that have penetrated several mm into the fine pores of the wall material also evaporate or react with the oxygen. This observation can be explained by the pore diffusion of $O_2$ in porous solid fuels.

By way of example, with an air impulse flow of 0.2(m·kg/S²) for fuel throughputs of 1 kg/hr. and larger, in well-conducted combustion, there was no trace of soot in flue gas with 13% by volume of $CO_2$. The production of an air impulse flow of $$\mathring{I}_1 = 0.2 \frac{m \cdot kg}{S^2}$$

affords a free stream cross-section of $$S = \frac{V^2}{\mathring{I}} \cdot \rho = 0.815 \cdot 10^{-4}\ m^2.$$

This cross-section is substantially smaller than that of the available central aperture of a conventional flame holder.

$$d_{min} = 16\ mm \rightarrow S_{min} = 2 \cdot 10^{-4}\ m^2.$$

By reason of the additionally available flow cross-section for flow around and through the flame holder, and also for assuring the exposure of a flame monitor photocell placed ahead of the flame holder in the flow direction, the effective air impulse flows lie in the range of <2 kg/hr., far below 0.2(m·kg/S²), which partially explains the uncertain combustion values in this range.

From these considerations it can be seen that with the small capacities aimed at, the through-flow cross-sections becomes too small, so that irregularities in operation occur. Therefore, these must be arranged to be larger, which however creates different operating conditions than with larger capacities and thereby throws up new problems.

Optimizing the vaporizer insert assures that it will, in the shortest possible time after burner start-up, assume a temperature that lies above the boiling temperature of the fuel (for heating oil EL>300° C.).

The process of heating the vaporizer insert, because of its relatively small mass, can be written, as a first approximation, as a first order differential equation, the solution to which is given by the following differential function:

$$I_w = I_l - (I_l - I_o)e^{t/\tau} - \theta(1 - e^{t/\tau})$$

wherein $I_w$=time—dependent wall temperature
$I_l$=gas temperature at the vaporizer outlet
$I_o$=wall temperature at start-up (t=1)
$\theta$=temperature reduction due to fuel evaporation
$\tau$=time constant.

The influence of the time constant is herein taken into account since, as a rule, the temperatures are established by operating conditions.

The time constant is given (S. Eckert, Wärmelehre) by:

$$\tau = \frac{V \cdot C \cdot \rho}{\alpha \cdot u \cdot l} = \frac{2 \cdot 11 \cdot C \cdot \rho \cdot Q_v^3}{u^3 \cdot \alpha^3 \cdot \lambda \cdot l \cdot \Delta I_k^3},$$

wherein all ribs that may be present in the vaporizer are taken into consideration in the value V, and wherein:

C=specific heat capacity of the material
$\rho$=density of the material
$\lambda$=heat conductivity of the material
$\alpha$=heat transfer coefficient (flame core wall)
u=effective circumference of the insert (heat conductor)
l=effective length of the insert
$Q_v$=evaporation capacity
$\Delta I_k$=temperature difference ($I_l - I_k$) after $t \rightarrow \infty$
$I_k$=wall temperature at the location with the highest fuel-mass flow density
S=cross-section surface of the insert.

With $Q_v$ established as a given value, the time constant is especially strongly minimized by the selection of the effective circumference u as well as by the influence of the heat transfer coefficient $\alpha$.

The selection of material is limited by considerations of strength, corrosion and fabrication. Of the three mentioned materials—silica nitride, aluminum titanate and glass—silica nitride is unequivocally best suited. In addition to its thermal characteristics, it is exceptionally workable by extrusion, drawing and casting and thus lends itself to optimum design.

To minimize the time required for heating the vaporizer insert, its inner effective circumference u can be increased by ribbing or similar profiling. Further measures for reducing the heating time include stepped formation of the surface of the insert to bring about an increase in the effective length l while maintaining a basic length. The stepping has the further advantage of causing detachment of the flow in the boundary layer and thereby increasing the heat transfer coefficient $\alpha$.

Thus, at a small technical cost and with the maintenance of established combustion principles, particularly those for oil combustion, the combustion quality with oil pressure atomization is rendered extraordinarily independent of the oil cloud quality as well as of the geometry and the thermodynamic conditions of the combustion chamber. Furthermore, sooting of functionally important parts, such as the flame holer, is prevented. A good combustion quality is obtained in the capacity range below 2kg/hr. with oil pressures below 7 bars, with the capability for employment of a conventional photoelectric flame monitor. Also, intermittent operating conditions are avoided with simple measures.

With the above described embodiments of the invention, the residueless vaporization and oxidizing of the fuel, as an additional preparation of the fuel for combustion, is assured by evaporation of the large drops in the margin of the fuel cone on a stationary hot surface with an oxidizing medium flowing over and through that surface.

The assured maintenance of a stable flame core and flame cone, produced and supported immediately after burner start-up, affords delivery of the necessary heat for heating the vaporizer surface as well as the light needed for the exposure of a conventional photoelectric flame monitor.

Conducting all of the combustion air through the mixture plane of a mixing device with a flame holder produces there a maximum air impulse flow, wherewith the air is not divided into individual streams until after it has passed through the mixing plane and is reintroduced into the vaporizer.

By the thermal decoupling of the vaporizer insert from its supporting elements, the excessive conduction of heat away from the vaporizer is prevented. In the vaporizer insert, adequate vaporizing heat at the surface with the greatest fuel mass flow density is assured by its optimal geometrical and thermodynamic design on the basis of:

1. a minimum time constant that describes its heating process $$\tau = \frac{V \cdot c \cdot}{\cdot u \cdot l} [S]$$

2. a maximum axial heat flow $$Q_v = m \cdot \lambda \cdot S \cdot \tanh(m \cdot 1) I_k [W].$$

I claim:

1. A liquid fuel burner particularly suited for low rates of fuel combustion, comprising an atomizer nozzle having a mouth at its front from which liquid fuel issues as a spray that is mainly in the form of a forwardly divergent cone of droplets substantially coaxial with said nozzle, and a combustion air duct through which combustion air flows forward to be mixed and combusted with the sprayed fuel, said fuel burner being characterized by:

A. an annular flame holder coaxial with the nozzle and spaced a small distance forward from it, having a central aperture through which substantially all of said spray passes;

B. a duct-like fuel vaporizer defining a zone in which combustion takes place, said fuel vaporizer being substantially concentric to the nozzle, spaced a small distance forward from said flame holder and (1) having a forwardly convergent inlet section, (2) having a diffuser section which extends forwardly from said inlet section and which has an inner surface that diverges forwardly and is so spaced from the mouth of the nozzle that between about 20% and about 40% of said spray can impact the same, (3) being of a material that conducts heat readily so as to be quickly heated by combustion in said zone to a temperature at which spray droplets impacting said surface are vaporized, and (4) being supported by said combustion air duct in thermally insulated relation thereto; and C. said combustion air duct having a portion connected with the inlet section of the fuel vaporizer and coaxially surrounding the flame holder in radially spaced relation thereto to cooperate with the periphery of the flame holder in defining an annular passage, said portion of the combustion air duct thus constraining all combustion air from said combustion air duct to enter the inlet section of the fuel vaporizer, part of such air through said central aperture in the flame holder and the remainder through said annular passage.

2. The liquid fuel burner of claim 1 wherein said vaporizer has a maximum wall thickness forwardly adjacent to said inlet section, to be capable of greatest heat retention in the region where maximum impact of fuel droplets, and therefore maximum fuel vaporization, takes place.

3. The liquid fuel burner of claim 1 wherein said vaporizer is of silica nitride.

4. The liquid fuel burner of claim 1 wherein at least a front portion of the vaporizer has an inner surface which is longitudinally ridged.

5. The liquid fuel burner of claim 1, further characterized by:

D. the length of the diffuser section of the fuel vaporizer being not less than the distance from the nozzle mouth to the nearest location on the vaporizer at which fuel droplets can contact its inner surface.

* * * * *